US005147767A

United States Patent [19]

Knapp

[11] Patent Number: 5,147,767

[45] Date of Patent: Sep. 15, 1992

[54] GLUCONIC ACID-BASED DEVELOPER COMPOSITION

[76] Inventor: Audenried W. Knapp, 225 Larch Rd., Frankfort, Ill. 60423

[21] Appl. No.: 683,248

[22] Filed: Apr. 10, 1991

[51] Int. Cl.[5] ..... G03C 5/30

[52] U.S. Cl. ..... 430/435; 430/268; 430/416; 430/441; 430/464; 430/491

[58] Field of Search ..... 430/268, 416, 435, 441, 430/464, 491

[56] References Cited

U.S. PATENT DOCUMENTS

| | | | |
|---|---|---|---|
| 4,157,262 | 6/1979 | Kubotera | 430/414 |
| 4,232,112 | 11/1980 | Kuse | 430/461 |
| 4,840,879 | 6/1989 | Kamitakahara et al. | 430/406 |

*Primary Examiner*—Hoa Van Le

[57] ABSTRACT

An environmentally-safe, non-toxic non-hydroquinone and non-alkali metal hydroxide containing photographic developer composition is provided comprising a developer selected from the group consisting of 2-keto gluconic acid and derivatives thereof, together with a sulfite, an alkali metal carbonate, and a 3-pyrzaolidone developer compound.

31 Claims, No Drawings

GLUCONIC ACID-BASED DEVELOPER COMPOSITION

BACKGROUND OF THE PRESENT INVENTION

The present invention is directed to an environmentally-safe, non-toxic photographic developer composition.

Photographic developer compositions are well-known in the art. The processing of silver halide photographic materials is performed by a multiple step sequence consisting of development, stopping, fixing and washing steps.

The development step is conventionally undertaken with an aqueous alkaline developer composition containing a developer such as hydroquinone and/or other well-known developing agents.

More specifically, the exposure of a silver halide emulsion to radiation to which the emulsion is sensitized produces a latent image in the silver halide grains of the emulsion. The latent image is developed by immersion of the exposed emulsion in an aqueous developing solution which contains a reducing agent (or developer). The hydroquinone or other suitable developer material serves as a strong silver reducing agent to reduce the exposed silver halide grains to yield the developed photographic image.

Exemplary hydroquinone-based developer compositions are disclosed in, for example, U.S. Pat. Nos. 2,893,865; 3,733,199; 3,865,591; 4,046,571; 4,205,124; 4,756,990; and 4,816,384. Normally, these compositions contain relatively high levels of sulfite-based components.

It is also important to maintain the pH of the developer composition within strict alkaline ranges to ensure satisfactory operation of the composition. As a result, caustic alkalis (caustic soda or caustic potash) are frequently employed in the developer composition.

While hydroquinone-based developer compositions have been employed with success for many years, more recently the use of such compositions has met with some doubt due to the toxicity and environmental hazards posed by the use of the hydroquinone, sulfite and caustic alkali components. That is, due to the toxic nature of various of the components employed in conventional developer compositions, and the resultant high pH, it is necessary to meet various guidelines and regulations promulgated to protect either the health of those who are exposed to such compositions or to protect the environment into which such compositions are disposed. As two of the least desirable of the components generally present in conventional developer compositions are hydroquinone and related materials and caustic alkalis, it would thus be desirable to discover acceptable substitutes therefore which are less toxic by nature.

OBJECTS AND SUMMARY OF THE PRESENT INVENTION

It is thus one object of the present invention to provide a developer composition which does not require the presence of hydroquinone-type developer components.

It is also an object of the present invention to provide a developer composition which does not require the presence of large amounts of caustic alkali components such as alkali metal hydroxides to ensure the proper pH for the developer composition.

It is further an object of the present invention to provide a developer composition which is comprised of components which are substantially less toxic by nature and which may be safely disposed of without fear of contamination of the environment.

It is further an object of the present invention to provide a developer composition which employs a substantially non-toxic reducing agent for silver as a substitute for hydroquine-based developers.

In accordance with the present invention, there is thus provided a non-hydroquinone and non-alkali metal hydroxide containing photographic developer composition comprising a developer comprised of 2-keto gluconic acid and potassium, sodium, ammonium and methyl derivatives thereof, together with a sulfite, an alkali metal carbonate, and a 3-pyrazolidone compound.

In accordance with the present invention, there is also provided a method of effecting development of an exposed photographic material which comprises effecting development of the material while in contact with the above developer composition.

DETAILED DESCRIPTION OF THE PRESENT INVENTION

The present invention pertains to a non-hydroquinone containing photographic developer composition which requires neither a toxic hydroquinone-type developer nor a caustic alkali pH control agent. Instead, it has been found that such components can be replaced with success with substantially non-toxic components and the amounts of any toxic components which are present being reduced significantly.

Specifically, it has been surprisingly found that in lieu of the toxic hydroquinone developers of the prior art, a developer may be employed comprised of 2-keto gluconic acid and derivatives thereof such as 2-keto gluconates, potassium, sodium, ammonium and methyl derivatives thereof.

Representative developers identified above have the following structure:

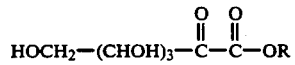

where R is H, Na, K, $NH_3$ or $CH_3$.

A developer composition which enables the desired advantages to be achieved (i.e., rapid development times in the absence of undesirable components) has accordingly been surprisingly and unexpectedly found which comprises the novel developers of the present invention together with a sulfite, an alkali metal carbonate, and a 3-pyrazolidone compound, said composition having a pH of from 9.50 to 11.75, and the respective components being present in specified proportions and/or ratios as discussed hereinafter.

This composition may be successfully employed without need of a hydroquinone-type developer and without need of a caustic alkali as a pH control agent or large amounts of sulfite preservative. The composition enables an image density of at least 4 to be achieved at development times of 60 seconds or less.

The developer composition may contain a multitude of conventional additives which serve various functions such as additional developing agents, antifogging agents, buffers, sequestering agents, swelling control agents, development accelerators, etc.

For example, antifogging agents or restrainers (e.g., soluble halides such as sodium or potassium bromides and organic antifogging agents such as benzotriazole or phenylmercaptotetrazole) may be employed to retard the development of non-exposed silver halide and to decrease the occurrence of fog (i.e., the production of silver formed by development of non-exposed silver halide).

More specifically, exemplary organic antifogging agents include but are not limited to derivatives of benzimidazole, benzotriazole, tetrazole, imidazole, indazole, thiazole, and mercaptotetrazole used alone or in admixture.

Carbonate ions are also desirably present to enhance pH stability. Sources of such ions may be potassium or sodium carbonate. Bromide ions may also be desirably present.

Antioxidants such as alkali sulfites are generally present in a hydroquinone-type developer to limit oxidation of the developing agents. However, in the present invention the alkali sulfites that are normally employed in a ratio of 200 to 300% of the quantity of hydroquinone are desirably reduced to approximately from 10% to 100% of the amount of developing agent and serve primarily as a development accelerator.

Small amounts of sequestering agents (or chelating agents) are also generally employed to sequester trace metal ions (such as copper and iron ions) present in the water or chemicals used to produce the developer composition. Such trace metal ions serve to undesirably oxidize the developer component in the composition. Exemplary sequestering agents include but are not limited to aminopolycarboxylic acid compounds, ethylenediaminotetraacetic acid (EDTA) and sodium salts thereof, diethylenetriaminopentacetic acid (DTPA), diaminopropanoltetracetic acid (DPTA), etc. Suitable sequestering agents are known to those skilled in the art and need not be discussed in further detail.

The additional presence of a 3-pyrazolidone developing agent (or derivative thereof) results in a synergistic effect upon the speed of development of the developer composition. That is, such compounds enhance the rate by which image density is achieved over a given period of time at a specific temperature.

Among the 3-pyrazolidone developing agents which may be useful in the developer composition of the present invention are those of the formula:

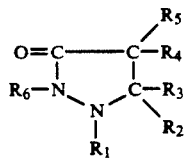

in which $R_1$ can be an alkyl group containing 1 to 12 carbon atoms, benzothiazolyl or an aryl group of the benzene or naphthalene series, substituted or not; $R_2$, $R_3$, $R_4$ and $R_5$ can be hydrogen, alkyl groups containing 1 to 12 carbon atoms, or aryl groups such as phenyl and napthyl, substituted or not; and $R_6$ can be hydrogen, an alkyl group, an acyl group or an aryl group; as well as salts thereof.

Typical 3-pyrazolidone compounds which may be employed include but are not limited to 4-(hydroxymethyl)-4-methyl-1-phenyl-3-pyrazolidone, 1-phenyl-3-pyrazolidone, 1-tolyl-3-pyrazolidone, 1-phenyl-4-methyl-3-pyrazolidone, 1-phenyl-4,4-dimethyl-3-pyrazolidone, 1-p-chlorophenyl-3-pyrazolidone, 5-phenyl-3-pyrazolidone, 1-phenyl-5-methyl-3-pyrazolidone, 1-m-tolyl-3-pyrazolidone, 1-p-methoxyphenyl-3-pyrazolidone, etc. Additional representative examples of suitable 3-pyrazolidone compounds are disclosed in U.S. Pat. Nos. 2,688,549, 3,865,591 and 4,269,929, each herein incorporated by reference.

COMPARATIVE EXAMPLE

The following is an example of a prior art developer composition which employs both hydroquinone and a caustic alkali pH control agent and which may successfully be replaced by the novel developer compositions of the present invention:

| | |
|---|---|
| Sodium sulfite | 24.0 gms |
| Potassium metabisulfite | 13.2 |
| $Na_4EDTA$ | 0.6 |
| 4-(hydroxymethyl)-4-methyl-1-phenyl-3-pyrazolidone | 0.4 |
| Benzotriazole | 0.09 |
| 1-phenyl-5-mercaptotetrazole | 0.008 |
| Hydroquinone | 15.9 |
| Potassium carbonate | 24.0 |
| Sodium bromide | 1.43 |
| Caustic potash | 18.3 |
| Water to 1.0 liter | |

A sheet of camera speed negative film manufactured by E.I. du Pont (ONF) was exposed with a WEJEX sensitometer, manufactured by Tobias Associates, at the low intensity setting, employing a 21 step gray scale made by Stouffer Graphic Arts Co. This strip was processed for 25 seconds at 35° C. in the above developer composition at a pH of 10.65. The transmission density at step 1 was 5.57. The density in step 12 was 0.04.

EXAMPLE 1

The following is an example of a developer composition prepared according to the teachings of the present invention which desirably avoids the presence of hydroquinone or caustic alkali and is formulated for use in roller transport processors (pH adjusted to 10.45 with potassium carbonate):

| | |
|---|---|
| Sodium sulfite | 15.0 gms |
| $Na_4EDTA$ | 0.6 |
| 4-(hydroxymethyl)-4-methyl-1-phenyl-3-pyrazolidone | 0.4 |
| Benzotriazole | 0.09 |
| 1-phenyl-5-mercaptotetrazole | 0.008 |
| Methyl 2-keto gluconate | 30.0 |
| Potassium carbonate | 24.0 |
| Sodium bromide | 1.43 |
| Sodium metabisulfite | 5.6 |
| Water to 1.0 liter | |

A strip exposed in the same manner as the Comparative Example that was processed in a developer composition containing hydroquinone, was processed for 25 seconds in the developer composition of Example 1 at 35° C. and at a pH of 10.45. The resultant image density in step 1 was 5.5. The density in step 12 was 0.08. These results are basically identical to those obtained from the strip processed in the hydroquinone-containing developer composition of the Comparative Example.

EXAMPLE 2

The following is an example of a developer composition prepared according to the teachings of the present invention which advantageously avoids the presence of hydroquinone or caustic alkali and is formulated for tray use (pH adjusted to 10.4 with potassium carbonate):

| | |
|---|---|
| Sodium sulfite | 12.5 gms |
| $Na_4EDTA$ | 2.3 |
| 4-(hydroxymethyl)-4-methyl-1-phenyl-3-pyrazolidone | 1.04 |
| Methyl 2-keto gluconate | 75.0 |
| Potassium carbonate | 26.4 |
| Sodium bromide | 10.0 |
| Water to 1.0 liter | |

EXAMPLE 3

The following is an example of a developer composition prepared according to the teachings of the present invention which advantageously avoids the presence of hydroquinone or caustic alkali:

| | |
|---|---|
| Sodium sulfite | 5.0 gms |
| Sodium metabisulfite | 2.8 |
| $Na_4EDTA$ | 0.6 |
| 4-(hydroxymethyl)-4-methyl-1-phenyl-3-pyrazolidone | 2.0 |
| Benzotriazole | 0.09 |
| 1-phenyl-5-mercaptotetrazole | 0.008 |
| Methyl 2-keto gluconate | 24.0 |
| Potassium carbonate | 24.0 |
| Sodium bromide | 2.7 |
| Water to 1.0 liter | |

The developer compositions of the present invention are also frequently prepared in the form of solid mixtures (powder form) of various components such as the developer, anti-fogging agent, sequestering agent, etc., with the developer composition converted to an aqueous form by the addition of the requisite amount of water in proportions consistent with the teachings of the present invention.

The composition of the present invention is alkaline by nature to permit its successful use as a developer. The pH of the developer composition in aqueous solution should be within the range of from about 9.50 to 11.75, and preferably within the range of from about 10.0 to 10.5. At pH's in excess of about 11.0, the developer composition is subject to degradation, while at pH's below about 9.50 the developer composition exhibits an undesirable reduction in activity.

The alkalinity of the composition may be maintained within the desired range by the presence of an alkali metal carbonate such as sodium or potassium carbonate. Sufficient carbonate should be present to ensure maintenance of the solution pH within the desired range.

An antioxidant such as sodium sulfite or sodium metabisulfite is also preferably present. Such sulfite compounds are normally employed in developer compositions as preservatives; however, such compounds serve the additional function of an accelerating compound in the present developer composition.

Exemplary sulfite compounds include those sulfur compounds capable of forming sulfite ions in aqueous solutions, such as alkali metal or sulfites, bisulfites, metabisulfites, and carbonyl-bisulfite adducts. More specifically, such sulfite compounds include sodium sulfite, potassium sulfite, sodium bisulfite, potassium metabisulfite, etc.

It has been determined that the amount of sulfite employed will generally be 10 to 50% of that normally employed in hydroquinone-containing developer compositions, which constitutes an additional advantage.

As a result, the developer composition of the present invention may, by way of example, be comprised (based on 1.0 liter of aqueous composition) of the above components within the following exemplary ranges:

| Component | Grams/liter |
|---|---|
| Alkali sulfite | 2 to 20 |
| Sequestering agent (e.g., $Na_4EDTA$) | 1 to 3 |
| 3-pyrazolidone | 0.2 to 4 |
| Benzotriazole | 0.08 to 1 |
| 1-phenyl-5-mercaptotetrazole | 0.005 to 0.5 |
| 2-keto gluconic acid developer or derivative | 15 to 80 |
| Alkali metal carbonate | 15 to 40 |
| Sodium bromide | 1 to 10 |

The above exemplary ranges for various specific compounds which may be employed with success in the developer composition of the present invention may vary somewhat taking into account differences such as molecular weight in related derivatives of such compounds (such as the use of sodium carbonate versus potassium carbonate). Such modifications of the above ranges is well within the ability of one skilled in the art.

With regard to the use of the developer composition of the present invention, the time and temperatures employed during the development step can vary widely. For instance, the development temperature can range from about 20° to 45° C. while the development time can vary from about 10 to 200 seconds.

After development, the silver halide material is fixed in a fixing composition, washed, and dried in a conventional manner.

What is claimed is:

1. A method of effecting development of an imagewise exposed photographic material comprising effecting development of said material while in contact with an aqueous, alkaline photographic developer composition comprising a developer selected from the group consisting of 2-keto gluconic acid and derivatives thereof.

2. The method of claim 1, wherein said composition further comprises a sulfite.

3. The method of claim 1, wherein said developer further comprises an alkali metal carbonate.

4. The method of claim 1, wherein said developer is selected from the group consisting of 2-keto gluconic acid and sodium, potassium, ammonium and methyl-based derivatives thereof.

5. The method of claim 4, wherein said developer comprises methyl 2-keto gluconate.

6. The method of claim 4, wherein said developer comprises 2-keto gluconic acid.

7. The method of claim 1, wherein said composition further comprises a component selected from the group consisting of a sequestering agent, an anti-fogging agent, and mixtures thereof.

8. The method of claim 2, wherein said sulfite is selected from the group consisting of sodium and potassium sulfite.

9. The method of claim 1, wherein said composition further comprises a 3-pyrazolidone compound.

10. The method of claim 9, wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

11. The method of claim 1, wherein said composition has a pH within the range of from 9.5 to 11.75.

12. A non-hydroquinone and non-alkali metal hydroxide containing photographic developer composition comprising a developer selected from the group consisting of 2-keto gluconic acid and derivatives thereof, together with a sulfite, an alkali metal carbonate, and a 3-pyrazolidone compound, said composition having a pH of from 9.50 to 11.75, said developer being present in an amount of at least about 15 grams, said sulfite being present in an amount of from 2 to 20 grams, and said carbonate being present in an amount of from 15 to 30 grams, and water to 1.0 liter.

13. The developer composition of claim 12 wherein said developer is selected from the group consisting of 2-keto gluconic acid and sodium, potassium, ammonium and methyl-based derivatives thereof.

14. The developer composition of claim 12 wherein said developer comprises methyl 2-keto gluconate.

15. The photographic developer of claim 12 further comprising a component selected from the group consisting of a sequestering agent, an anti-fogging agent, and mixtures thereof.

16. The photographic developer of claim 12 wherein said sulfite is selected from the group consisting of sodium and potassium sulfite.

17. The photographic developer composition of claim 12 further comprising a sequestering agent.

18. The photographic developer composition of claim 17 wherein said sequestering agent comprises EDTA or a salt thereof.

19. The photographic developer composition of claim 12 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

20. The photographic developer composition of claim 12 wherein said developer composition comprises 4-(hydroxymethyl)-4-methyl-1-phenyl-3-pyrazolidone, benzotriazole, 1-phenyl-5-mercaptotetrazole, potassium carbonate, and sodium bromide.

21. The photographic developer composition of claim 18 comprising $Na_4EDTA$.

22. A method of effecting development of an imagewise exposed photographic material comprising effecting development of said material while in contact with a non-hydroquinone and non-alkali metal hydroxide containing aqueous development medium comprising a developer selected from the group consisting of 2-keto gluconic acid and derivatives thereof, together with a sulfite, an alkali metal carbonate, and a 3-pyrazolidone compound, said composition having a pH of from 9.50 to 11.75, said developer being present in an amount of at least about 15 grams, said sulfite being present in an amount of from 2 to 20 grams, and said carbonate being present in an amount of from 15 to 30 grams, and water to 1.0 liter.

23. The method of claim 22 wherein said developer is selected from the group consisting of 2-keto gluconic acid and sodium, potassium, ammonium and methyl-based derivatives thereof.

24. The method of claim 22 wherein said developer comprises an alkaline metal salt.

25. The method of claim 22 wherein said developer is methyl 2-keto gluconate.

26. The method of claim 22 further comprising a component selected from the group consisting of a sequestering agent, an anti-fogging agent, and mixtures thereof.

27. The method of claim 22 wherein said sulfite is selected from the group consisting of sodium and potassium sulfite.

28. The method of claim 22 further comprising a sequestering agent.

29. The method of claim 28 wherein said sequestering agent comprises EDTA or a salt thereof.

30. The method of claim 22 wherein said 3-pyrazolidone compound is selected from the group consisting of 1-phenyl-3-pyrazolidone, 1-p-tolyl-3-pyrazolidone, 1-phenyl-4-methyl-3-pyrazolidone, 1-phenyl-4,4-dimethyl-3-pyrazolidone, and 1-p-chlorophenyl-3-pyrazolidone.

31. The method of claim 22 wherein said developer composition comprises 4-(hydroxymethyl)-4-methyl-1-phenyl-3-pyrazolidone, benzotriazole, 1-phenyl-5-mercaptotetrazole, potassium carbonate, and sodium bromide.

* * * * *